United States Patent [19]

Solloway

[11] Patent Number: 4,819,951

[45] Date of Patent: Apr. 11, 1989

[54] AQUATIC DUMBELL

[76] Inventor: Daniel S. Solloway, 11121 Ashford Dr., Yukon, Okla. 73099

[21] Appl. No.: 75,357

[22] Filed: Jul. 20, 1987

[51] Int. Cl.[4] ..... A63B 21/00

[52] U.S. Cl. ..... 272/116; 272/130

[58] Field of Search ..... 272/116, 130, 71, 96, 272/122, 123, 68, 67; 441/55-59; 434/254

[56] References Cited

U.S. PATENT DOCUMENTS

| | | | |
|---|---|---|---|
| 3,424,133 | 1/1969 | Brady | 272/116 X |
| 3,786,526 | 1/1974 | Ausseil | 272/71 X |
| 4,458,896 | 7/1984 | Solloway | 272/116 |
| 4,623,142 | 11/1986 | McKechnie | 272/116 |
| 4,623,387 | 12/1986 | Guzman | 441/58 X |
| 4,685,667 | 8/1987 | McDonald | 272/116 X |

*Primary Examiner*—Richard J. Apley
*Assistant Examiner*—Howard Flaxman
*Attorney, Agent, or Firm*—Thomas W. Tolpin

[57] ABSTRACT

Aquatic exercise devices, such as in the form of an aquatic dumbbell, are provided for interchangeable and comfortable use by men, women and children alike. The aquatic exercise devices permit a large range of movement and increased resistive forces, torque and torsion. The aquatic exercise devices serve as fluid resistors to water flow as the devices are moved through the water. The aquatic dumbbell can have an array of axial fins and outer diverging transverse fins to provide enhanced strength building and hydrodynamic resistance.

10 Claims, 5 Drawing Sheets

20
22
24
26
28
34
36
38
40
42
46
48
50
52
54
62
64
66
68
70
75
76
77
78
84
86
88
90
92
94
96
98
100
101
102
104
106
108
110

20
22
24
26
28
34
36
38
40
42
50
52
54
62
64
66
68
70
72
74
75
77
84
86
88
90
94
104
106
108
111
112
114
116

20
24
26
34
36
38
40
42
46
48
50
52
54
62
64
66
68
70
75
76
77
78
84
86
88
90
92
94
102
104
106
108
110
111
112
114
116
120
122
124

AQUATIC DUMBELL

BACKGROUND OF THE INVENTION

This invention relates to an exercise equipment, and more particularly, to an exercise assembly for use in water.

In the past, a variety of weight lifting and exercise devices equipment, such as barbells, have been developed. Typifying these weight lifting and exercise equipment and other devices are those shown in U.S. Pat. Nos. 373,692; 654,097; 660,692; 717,041; 1,260,931; 1,366,200; 1,676,689; 2,143,337; 3,260,523; 3,427,022; 3,463,492; 3,671,988; 3,809,397, 3,889,308; 4,029,312; 4,227,273; 4,300,759; 4,411,422; 4,311,306; 4,416,451; 4,458,896; 4,468,023; 4,521,011; 4,627,613; Des. 190,605; Des. 224,935; Des. 495,769; Des. 1,906,056; German Pat. No. 351,627; Italian Patent No. 615,402; British Pat. No. 8,729; British Pat. No. 13,630; British Pat. No. 495,769; and British Pat. No. 1,041,324. These weight lifting and exercise devices have met with varying degrees of success.

Many of the conventional weight lifting and land exercise equipment, however, are relatively awkward, cumbersome and complex and are not suitable for interchangeable use by men, women, and older children alike having different physical capabilities and strengths without extensive modifications. For example, barbells, as well as pulley and rope exercise devices have various size weights which usually must be adjusted, such as by adding or removing the weights from the exercise device, to accommodate the exercise device to the particular lifting strength and physical capability of the weight lifter. Furthermore, many of these conventional land exercise devices exert an excess amount of torque and torsion (twist) on the joints of the user and are, therefore, not usually suitable for many types of physical therapy.

It is, therefore, desirable to provide an improved aquatic exercise assembly which overcomes most, if not all, of the above disadvantages.

SUMMARY OF THE INVENTION

An improved exercise assembly is provided for use in water to strengthen muscles, improve muscle tone, and enhance muscular coordination. Advantageously, the exercise assembly is readily usable by men, women and children alike, having different strengths and physical capabilities without substantial modification.

The exercise assembly of this invention is to particularly useful for physical therapy in water because the torque, torsion and resistant forces which it exerts on the joints of the patient can be readily controlled by the physical therapist, by simply varying the acceleration or momentum of the aquatic exercise assembly to the desired amount. Desirably, the aquatic exercise assembly is easy to use and is relatively simple in design and construction for economy of manufacture.

To this end, the aquatic exercise assembly has an elongated generally impact-resistant water-engageably shaft or bar formed of a substantially water-impermeable material. The shaft is constructed and arranged for movement in the water and has a manually grippable handle portion for being grasped under water.

In order to axially deflect the water and create an axial pressure head and fluid resistance to water flow as the shaft is axially moved in the water, at least one concave outer transverse end fin is secured to and extends transversely outwardly from the end portion of the shaft to provide an outer hydrodynamic resistance assembly (i.e., an outer assembly which exerts an axial fluid resistance or pressure head as it is moved axially through the water). The transverse fin of the outer hydrodynamic resistance assembly has a conical, frustoconical, or cup-shaped configuration. The outer transverse fin has an in outwardly diverging axial water-impingement surface with a concave cross-sectional area for positioning generally normal to the direction of movement of the shaft to hydrodynamically engage the water. The cross-sectional area of the water-impingement surface spans a width in the radial direction (i.e., in a direction generally transverse to the axis of the shaft) substantially greater than the shaft's width to enlarge or intensify the axial water resistance of the water-impingement surface.

The outer hydrodynamic resistance assembly can include a plurality of outer fins which extend axially outwardly of the transverse fin to provide additional outer transverse pressure and fluid resistance. Preferably, the outer fins comprise outer radial fins which extend radially from an end portion of the shaft.

In the preferred form, the end portions of the shaft are secured t symmetrical outer hydrodynamic resistance assemblies (i.e. each end portion of the shaft is attached to an outer hydrodynamic resistance assembly) to provide a improved aquatic dumbbell.

In some circumstance, it may be desirable that only one end portion of the shaft have and be secured to an outer hydrodynamic resistance assembly to provide an aquatic baseball bat, an aquatic golf club, an aquatic hockey stick, an aquatic polo mallet, or an aquatic racket, such as a tennis racket, racquetball racket, or squash racket.

In order to transversely deflect the water and create a transverse pressure head and fluid resistance to water flow as the aquatic exercise assembly is moved transversely, twisted, pivoted arcuately, or rotated angularly in the water, the aquatic exercise assembly has elongated intermediate axial fins which extend between and connect the symmetrical outer transverse fins to provide an inner hydrodynamic resistance assembly (i.e. an inner assembly which exerts transverse fluid resistance and pressure head as it is transversely moved, twisted, pivoted, or rotated in the water). The intermediate axial fins can have radial portions which extend radially outwardly from the shaft adjacent the transverse fins and outer end portions of the shaft, and intermediate axial portions which are positioned substantially parallel to and spaced radially outwardly of the shaft.

In the preferred form, at least one bridge fin laterally connects at least one pair of adjacent axial fins to create a supplemental lateral pressure head when the aquatic exercise assembly is moved in the water. The bridge fin can have an axial bridge portion and a transverse bridge portion.

One or more of the fins can have raised ribs and indented portions to provide hydrodynamic pockets to increase the hydrodynamic resistance of the aquatic exercise assembly as the aquatic exercise assembly is move through the water. The indented portions also provide economy of material and a lighter weight aquatic exercise assembly.

Desirably, the hydrodynamic resistance assemblies are spaced an effective distance from the manual grippable handle portion of the shaft to exert a hydrodynamic torque (i.e., a torque exerted during movement of the aquatic exercise device through the water) on the handle portion as the shaft is being moved through the water.

As used throughout this application, the term "hydrodynamic resistance" means a fluid resistance exerted on the aquatic exercise assembly and user when the aquatic exercise assembly is moved in or through the water.

A more detailed explanation of the invention is provided in the following description and appended claims taken in conjunction with the accompanying drawings.

DETAILED DESCRIPTION OF THE PREFERRED EMBODIMENTS

Figure 1:
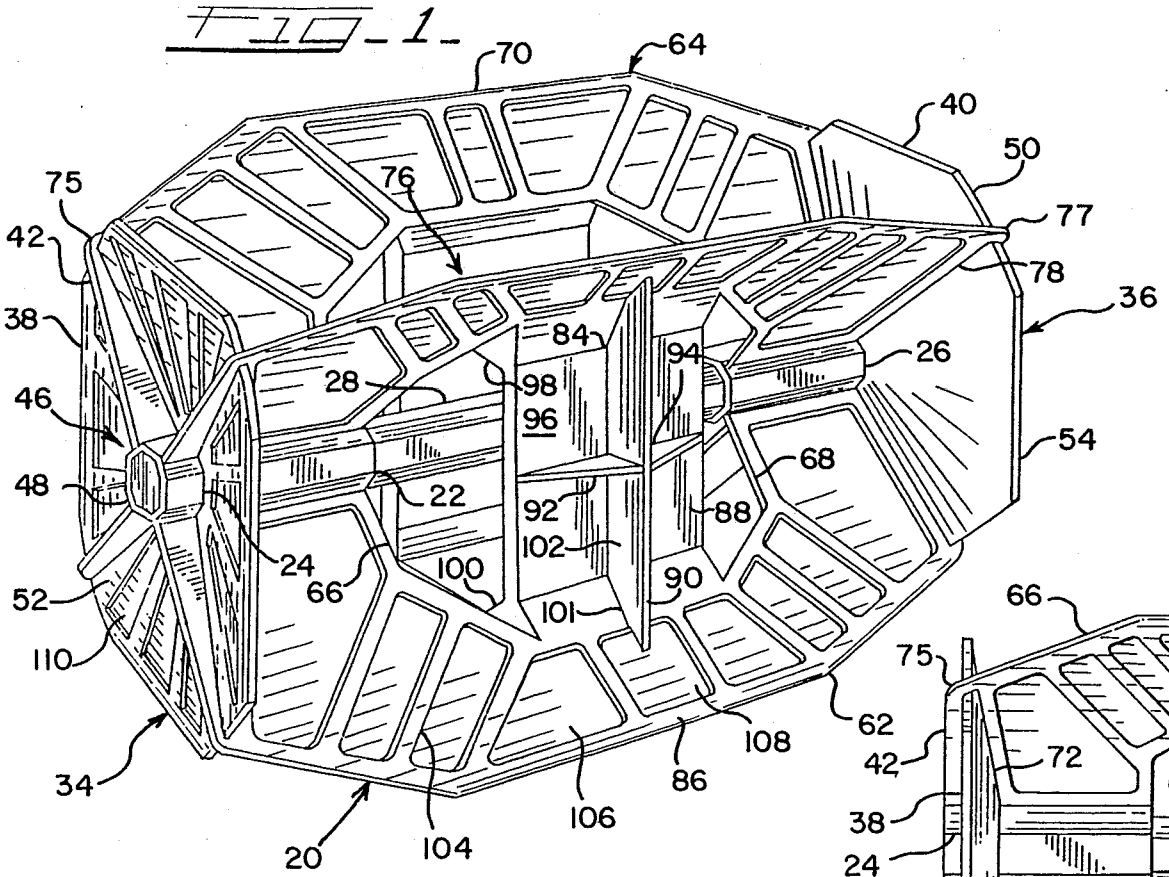
FIG. 1 is a perspective view of an aquatic dumbbell in accordance with principles of the present invention.

An aquatic exercise dumbbell 20 (FIGS. 1–8) provides an aquatic exercise assembly, sometimes referred to as an "aquatic exerciser," which is compact, easy-to-use, efficient, and effective. The portable aquatic dumbbell 20 can be comfortably used is in water by weight lifters, patients, paraplegics, and other persons desirous of strengthening their muscles, improving their muscle tone, and enhancing their muscular coordination. The aquatic exercise assembly 20 is helpful to improve the cardiovascular system and general physical well being and strength of the user.

The aquatic exercise assembly 20 is particularly useful to physical therapists because it permits a greater range of motion in the water than conventional barbells and many other types of conventional weight lifting and exercise devices that are used on land, such as in gymnasiums, and because it permits the physical therapist to control the magnitude of the forces, torque and torsion exerted by the assembly on the patient, while minimizing harsh impact forces and shock on the patient's joints. Such control can be exercised by selectively varying the acceleration or momentum of the assembly to the desired amount. Advantageously, the aquatic exercise assembly 20 can be used by men, women and children of various strengths and abilities without changing, adding or removing parts and components.

Structurally, the aquatic exercise assembly 20 has a substantially rigid water-engageable shaft 22, rod or bar that is formed of a substantially water-impermeable and impact-resistant material, such as lightweight aluminum or impact-resistant plastic. Other water-impermeable materials can be used. The shaft 22 has a left transverse fin-engaging end portion 24 at one end, and a right transverse fin-engaging end portion 26 at the other end. A manually grippable, middle handle portion 28 is positioned intermediate and between and connects the end portions 24 and 26 of the shaft 22. The end portions 24 and 26 can have a greater transverse span and diameter than the middle handle portion 28. If desired, the outer axial sections of the middle portion 28 of the shaft 22 can telescopically fit into and be connected to all or a portion of the outer end portions 24 and 26 of the shaft 22. The shaft 22 has an octagonal cross section to facilitate gripping and is tubular to minimize weight and reduce construction costs. The shaft 22 can be open ended or closed (covered) with plugs or end caps.

In the illustrative embodiment, the shaft 22 is generally rigid or stiff with the handle portion 28 spanning a length somewhat greater than the span of one hand so that it can be gripped by one hand. The shaft 22 is elongated and is generally straight or linear so as to extend longitudinally along an axis. The shaft 22 has a width taken in a radial direction that is generally transverse to axis. While the illustrated embodiment is preferred, in some circumstances, it may be desirable that the shaft be solid or of a different shape, such as being square cylindrical with knurled or other finger gripping portions, or that the shaft be more flexible or that handle portion be somewhat larger, longer, or smaller.

The shaft 22 also serves to rigidify and connect a pair of symmetrical, axially opposite, outer hydrodynamic resistance assemblies 34 and 36 that are securely connected to the transverse fin-engaging end portions 24 and 26, respectively, of the shaft 22. Each outer hydrodynamic resistance assembly 34 and 36 has an outer transverse end fin, plate, or blade 38 or 40 and a plurality of angularly disposed water-engageable outer radial blades or fins 42 which extend axially outwardly of the outer transverse fin 38 or 40. The transverse fins 38 and 40 are positioned generally perpendicular, abuttingly engage, and are securely connected to the shaft. The outer transverse fins 38 and 40 are substantially frustoconical and diverge axially outwardly to cuppingly engage the water and provide an outward concave frustoconical pocket 46 which creates an axial pressure head to water flow as the shaft 22 is moved axially through the water. The transverse fins 38 and 40 can have a polygonal periphery 48 with rounded arcuate edges 50 and have outer, generally imperforate, concave frustoconical, water-impingement surfaces 52 and 54 (FIG. 2) which increase hydrodynamic resistance of water flow as the aquatic exercise assembly 20 is moved through the water.

The outer radial fins or blades 42 extend radially outwardly from the end portions 24 and 26 of the shaft 22 and axially outwardly from the outer transverse fins 38 and 40. The outer radial fins 42 serve to deflect water and create a pressure head and fluid resistance to water flow as the shaft 22 is moved in or through the water. The outer radial fins 42 are generally triangular and planar. Preferably, there are at least two pairs of diametrically opposed outer radial fins 42 at each end 24 and 26 of the shaft 22. In the preferred embodiment, each of the two sets of diametrically opposed outer radial fins 42 are positioned generally perpendicular or at right angles to each other. Each of the adjacent outer radial fins 42 cooperate with each other to define an angular aquatic pocket 56 (FIG. 3) for cuppingly engaging water as the shaft is moved in the water.

Each of the outer radial blades 42 (FIG. 3) has a pair of opposed generally flat triangular water-impingement surfaces 58 and 60 which are positioned generally normal or perpendicular to the direction of movement of the shaft 22 to hydrodynamically engage the water as the shaft 22 is moved in the water. The water-impingement surfaces 58 and 60 span a radial width or height that is substantially greater than the width of the shaft 22, taken in a direction transverse to the axis, to increase or intensify the water resistance of the water-impingement surfaces.

The water resistance (resistive forces exerted by the transverse end fins 38 and 40 and the outer radial fins 42 as the shaft 22 is moved in the water can be increased by increasing the radial span or height of the transverse end fins 38 and 40 and the outer radial fins 42 and thereby enlarging the effective cross-sectional area that is positioned generally normal to the direction of movement of the shaft 22.

The transverse fins 38 and 40 and outer radial fins 42 and 44 are substantially made of the same material as the shaft 22. While the illustrated embodiment is preferred for best results, in some circumstances it may be desirable that the transverse fins and outer radial fins are flexible, foraminous (perforated), or have a different configuration or that one or more of the outer radial fins be omitted.

In order to transversely deflect the water and create a substantial transverse pressure head and fluid resistance to water as the aquatic exercise assembly 20 is moved transversely, twisted, pivoted arcuately, or rotated angularly in the water, the aquatic exercise assembly 20 has elongated, intermediate, angularly disposed, water-engageable, inner axial fins or blades 62 which extend between and connect the symmetrical outer transverse end fins 38 and 40, to provide an inner hydrodynamic resistance assembly 64. The inner hydrodynamic resistance assembly 64 exerts a transverse fluid resistance and pressure head as it is transversely moved, twisted, pivoted, or rotated in the water. The intermediate axial fins 62 can have axially opposed, outer radial portions 66 and 68 and elongated intermediate axial portions 70 which extend axially between and connect the radial portions 66 and 68. The outer radial portions 66 and 68 also extend axially inwardly from and are connected to the inner surfaces 72 and 74 (FIG. 2) of the transverse end fins 38 and 40. The outer edge sections 75 and 77 of the radial portions 66 and 68 provide flared straight edge portions which can be integrally connected to the outer radial fins 42 and extend radially outwardly of the rounded edges 50 of the transverse end fins 38 and 40. The flared outer edge sections 75 and 77 extend axially inwardly and radially outwardly of the transverse end fins 38 and 40 at an angle of inclination ranging from about 15 degrees to about 75 degrees. The intermediate axial portion 70 is positioned substantially parallel and spaced radially outwardly of the shaft 22. The outer edges of the axial portions 70 are substantially straight and positioned parallel to the shaft 22. The outer edges of the axial portions span a greater distance in the radial direction than the transverse end fins 38 and 40 and the outer radial fins 42. The spacing (space) between the axial fins 62 and the shaft 22 provides an access opening 76 (FIGS. 1 and 4) for grasping the shaft 22. The access opening 76 spans a transverse distance greater than the thickness of the user's hand.

The inner axial fins 62 serve to deflect water and create a transverse pressure head and fluid resistance to water flow as the shaft 22 is moved in or through the water. The inner axial fins 62 are generally U-shaped, planar, and flat. Preferably, there are at least two pairs of diametrically opposed, inner axial fins 62 which extend radially outwardly from the shaft 22. In the preferred embodiment, each of the two sets of diametrically opposed, inner axial fins 62 are positioned generally perpendicular and at right angles to each other. Each of the adjacent inner axial fins 62 cooperate with each other to define an angular aquatic pocket 78 (FIG. 1) for cuppingly engaging water as the shaft 22 is moved in the water. The axial fins 62 permit the aquatic dumbbell 20 to be made axially smaller (shorter) with greater hydrodynamic resistance than prior aquatic devices.

Each of the inner axial fins 62 has a pair of opposed generally U-shaped or C-shaped, planar, or flat, water-impingement surfaces 80 and 82 (FIG. 3) positioned generally normal or perpendicular to the direction of movement of the shaft 22 to hydrodynamically engage the water as the shaft 22 is moved in the water. The water-impingement surfaces 80 and 82 of the inner axial fins 62 span a radial width or height that is substantially greater than the width of the shaft 22, taken in a direction transverse to axis, to increase or intensify the water resistance of the water-impingement surfaces 80 and 82. The water resistance (resistive forces) exerted by the inner axial fins 62, as the aquatic exercise assembly 20 is moved in the water, can be increased by increasing the radial span or height of the inner axial fins 62 and thereby enlarging the effective cross-sectional area that is positioned generally normal to the direction of movement of the shaft 22.

The inner axial fins 62 in the illustrated embodiment are substantially rigid and imperforate. While the illustrated embodiment is preferred for best results, in some circumstances it may be desirable that the inner axial fins be flexible, curved, or foraminous (perforated). Furthermore, in some circumstances it may be desirable that the inner axial fins have a different configuration or that more or less inner axial fins be used with the aquatic exercise assembly. Moreover, the axial fins can include axial or curved rigidifying members or struts.

The inner axial fins 62 each have a generally planar or flat, imperforate water-impermeable cross-sectional area. The maximum height of axial fins 62 are preferably more than twice the maximum thickness of the manually grippable portion 28 of shaft 22. The transverse end fins 38 and 40 span a distance at least as great as the maximum diametric span or height of the axial fins 62 and occupy an area transversely surrounding the ends of the axial fins 62.

Lateral bridge fins 84 can extend between and connect the middle portions 86 of the intermediate axial fins 62 to provide water-resistive side barriers. The side barriers provide further lateral fluid resistance and lateral pressure heads when the aquatic dumbbell 20 is moved in the water. The lateral bridge fins 84 can have longitudinal (axial) bridge fin portions 88, transverse bridge fin portions 90, and radial bridge fin portions 92. The transverse bridge portions 90 extend transversely outwardly from the middle of the longitudinal (axial) bridge portions 88. The radial bridge portions 92 extend radially outwardly from the middle of the longitudinal (axial) bridge portions 88. The longitudinal, transverse, and radial bridge portions 88, 90, and 92 provide lateral side pockets 94 which transversely (sidewardly) engage the water. The elongated main body section 96 of the longitudinal bridge portions 88 are substantially rectangular, straight, planar, and flat. The symmetrical transverse ends 98 and 100 of the longitudinal bridge portions 88, which are secured to adjacent axial fins 62, are generally trapezoidal. The transverse bridge portions 90 are substantially trapezoidal, planar, and flat and have outwardly diverging edges 101. The radial bridge fin portions 92 are substantially triangular, planar, and flat. The bridge fins 84 are substantially rigid and made of the same material as the axial fins. The outer surfaces of the bridge fins 84 are imperforate and provide lateral water-impingement surfaces 102. At least one adjacent pair of axial fins 62 are not connected by a lateral bridge fin in order not to block the access opening 76 (FIGS. 1 and 4) through which the hand of the user grasps the shaft.

While the illustrated embodiment is preferred for best results, in some circumstances it may be desirable to have more than one bridge fin connecting adjacent inner axial fins, or that the bridge fins be curved or some other shape, or that they be flexible or perforated. Furthermore, if desired, the bridge fins can have a longitudinal (axial) bridge fin portion and/or a transverse bridge fin portion as well as an optional radial bridge fin portion.

The axial fins 62 and transverse fins 38 and 40, as well as the other fins 42 and 84 of the aquatic exercise assembly 20 can have raised ribs 104 and indented portions 106 to provide hydrodynamic pockets 108 to increase the hydrodynamic resistance of the aquatic exercise assembly 20 as the aquatic exercise assembly 20 is moved through the water. Some of the hydrodynamic pockets 108 of the intermediate axial fins 62 can be substantially rectangular. Some of the hydrodynamic pockets 110 of the outer transverse fins 62 can be substantially trapezoidal. While it is preferred that all surfaces of the intermediate axial fins 62 and the outer transverse fins 38 and 40 have raised 104 and/or indented 106 portions to provide auxiliary hydrodynamic pockets 108 and 110 for best results, in some circumstances it may be desirable that all or part of some of the surfaces of the intermediate axial fins 62 and/or the outer transverse fins 38 and 40 not have indented and raised portions.

Figure 2:
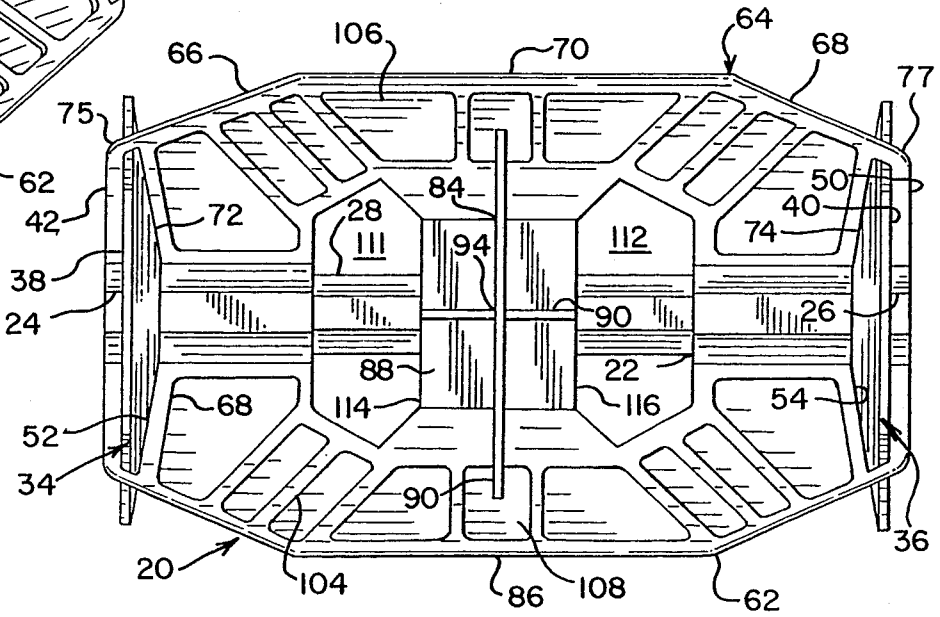
FIG. 2 is a front view of the aquatic dumbbell.
Figure 3:
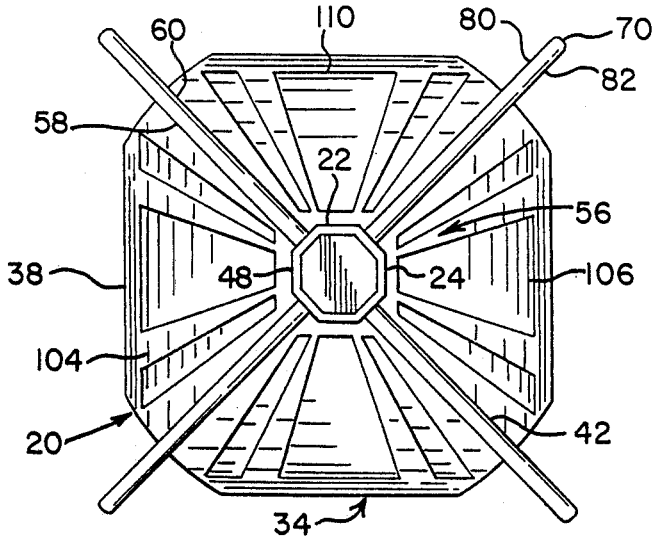
FIG. 3 is a left sideview of the aquatic dumbbell.
Figure 4:
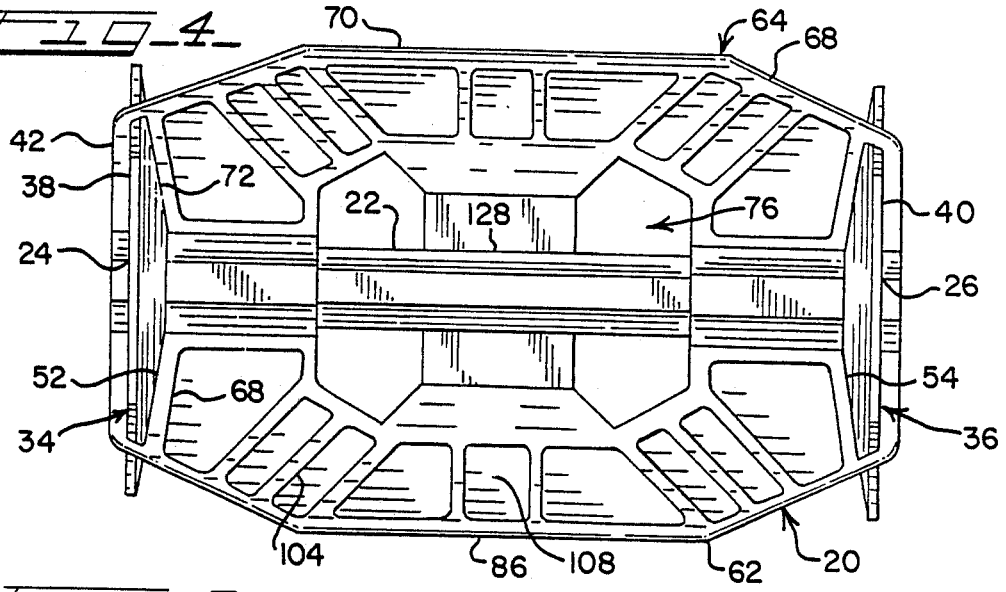
FIG. 4 is a top plan view of the aquatic dumbbell.
Figure 5:
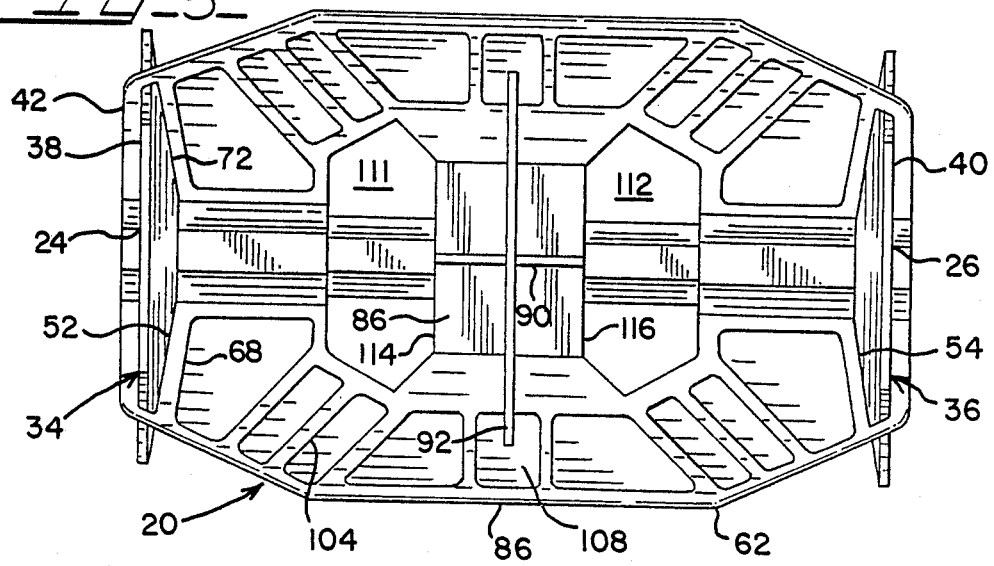
FIG. 5 is a bottom view of the aquatic dumbbell.
Figure 8:
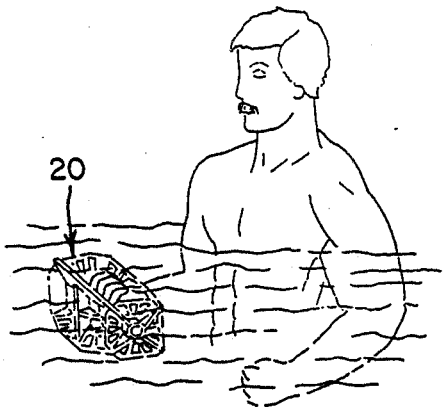
FIG. 8 is a reduced perspective view of the aquatic dumbbell being moved in water.
Figure 6:
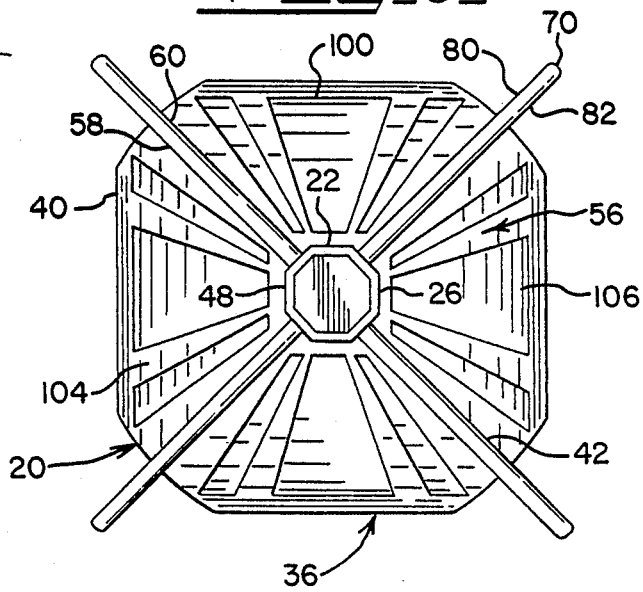
FIG. 6 is a right side view of the aquatic dumbbell.
Figure 7:
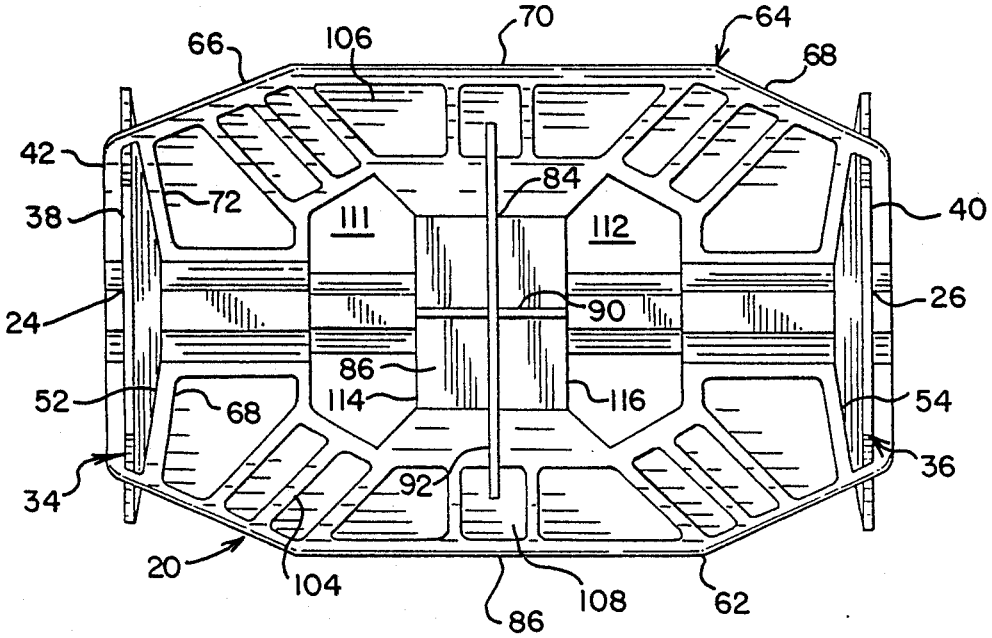
FIG. 7 is a back view of the aquatic dumbbell.

As shown in FIG. 2, generally hexagonal side openings 111 and 112 (spaces) are located between the outer edges 114 and 116 of the lateral bridge fins 84 and the radial portions 66 and 68 of the intermediate axial fins 62. The side openings 111 and 112 are also bounded by part of the axial portions 70 of the intermediate axial fins 62 and the outer portions of the shaft 22. The side openings 111 and 112 provide access to part of the intermediate portion 28 of the shaft 22.

Figures 9, 10:
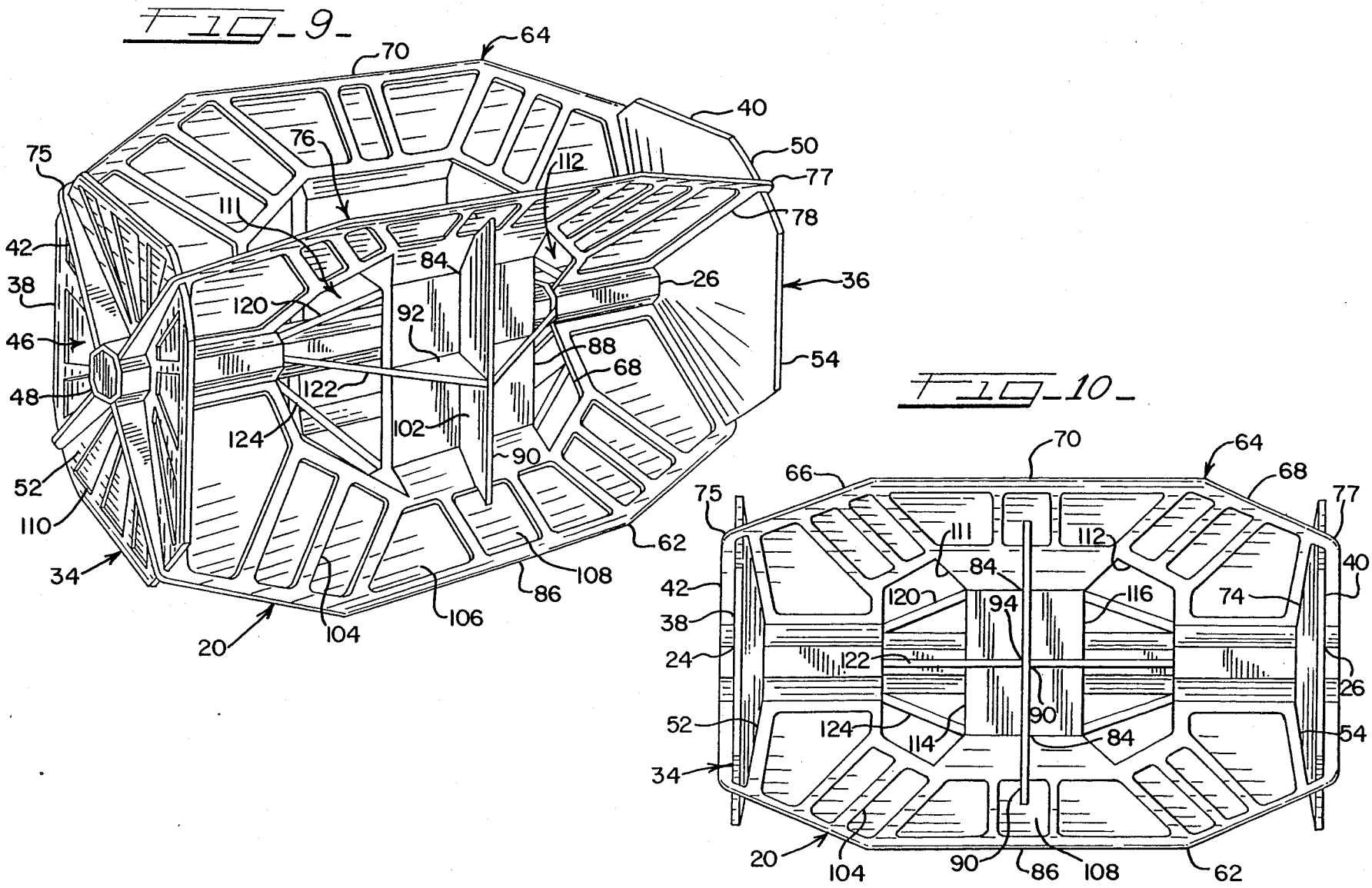
FIG. 9 is a perspective view of another embodiment of the aquatic dumbbell.
FIG. 10 is a front view of the aquatic dumbbell of FIG. 9.
Figure 11:
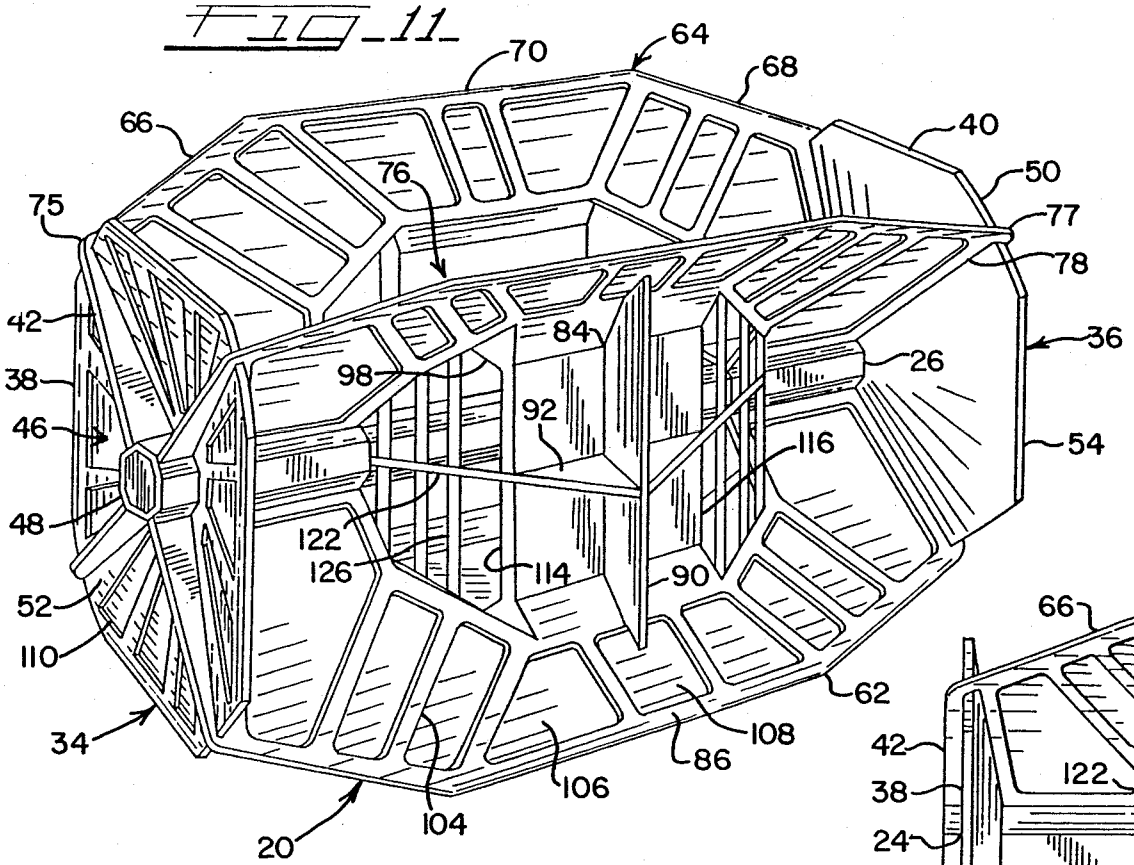
FIG. 11 is a perspective view of further embodiment of the aquatic dumbbell.

In the embodiment of FIGS. 9 and 10, a symmetrical set of inwardly diverging water-engageable side bars, spokes, ribs, or expansion fins 120, 122 and 124 extend between and connect the outer portions of the shaft 22 and the middle and ends of the main body section 96 of the longitudinal (axial) bridge fin portion 88. The inwardly diverging side bars (spokes) 120, 122, and 124 extend through and block the side openings 111 and 112. The inwardly diverging side bars (spokes) 120, 122, and 124 provide structural strength, rigidity, and additional transverse water resistance as the aquatic exercise assembly 20 is moved transversely in the water.

Figure 12:
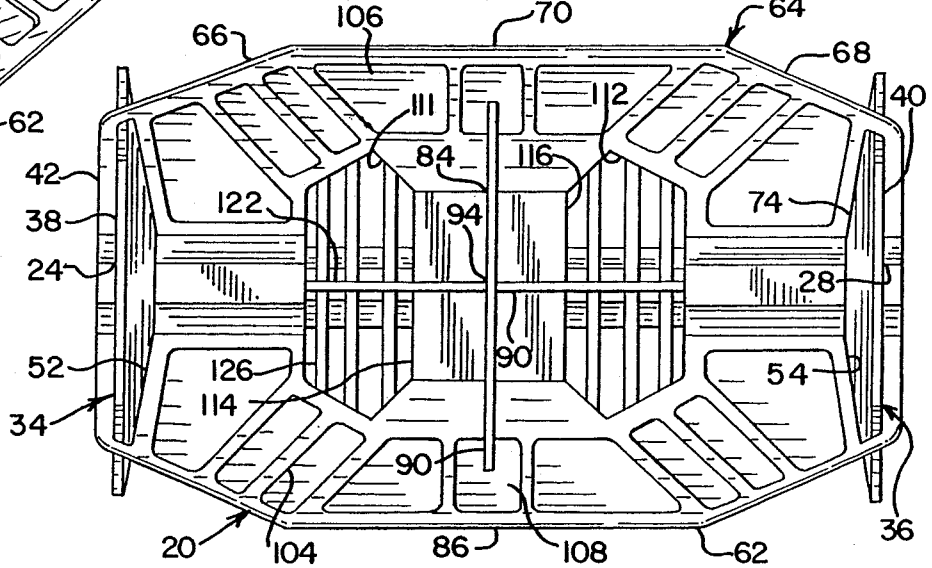
FIG. 12 is a front view of the aquatic dumbbell of FIG. 11.

In the embodiment of FIGS. 12 and 13, a symmetrical set of crisscross pattern and matrix of axial and transverse water-engageable side bars, spokes, ribs, or expansion fins 122 and 126 extend through and block the side openings 111 and 112. The axial side bar 124 (spokes) extend axially or horizontally between and connect the outer edges 114 and 116 of the bridge fins 84 and the radial portions 66 and 68 of the inner axial fins 62. The transverse side bars 126 (spokes) extend transversely or vertically between and connect the axial portions 70 of the inner axial fins 62 as well as the trapezoidal transverse ends 98 and 100 of the bridge fins 84. The crisscross pattern and matrix of axial 122 and transverse 124 side bars (spokes) enhance the structural strength and rigidity of the aquatic exercise assembly 20 and provide additional transverse water resistance as the aquatic exercise assembly 20 is moved transversely in the water.

The edges of the fins 38–42, 62 and 84 of each of the hydrodynamic resistance assemblies 34, 36, and 64 are preferably rounded. Desirably, the fins 38–42, 62 and 84 of each of the hydrodynamic resistance assemblies 34, 36, and 64 are spaced an effective distance from the handle portion 28 of the shaft 22 to exert a hydrodynamic torque ad hydrodynamic resistance on the handle portion 28 as the shaft 22 is moved in or through the water so as to strengthen the muscles of the user of the aquatic exercise assembly 20. If the user's hand is held in the middle 28 of the shaft 22 and the shaft 22 is not rotated or pivoted, the torque exerted by the fins 38 and 42 extending from the left-hand side of the shaft will counterbalance and offset the torque exerted by fins 38 and 42 extending from the right-hand side of the shaft 22.

While the illustrated embodiment is preferred for best results, it may be desirable in some circumstances, that there are more or less fins or at that the fins are positioned at different angles, or that the fins are curved or twisted or of a different shape or formed of a different material.

The axial fins and transverse fins can have flat portions which are spaced apart from each other to minimize rolling when the exercise assembly is laid on the floor or a pool deck. The fins of the aquatic exercise assembly can have rounded edges to avoid scratching or accidentally puncturing the skin and enhance safety.

In use, the aquatic exercise assembly 20 is moved or swung in the water at a selected acceleration and momentum to create the desired resistance, torque and torsion upon the arms of the person using the aquatic exercise assembly.

An auxiliary handle or swing arm can be connected to the shaft to swing (rotate) the dumbbell through the water in a simulated manner of a baseball bat, golf club, racquet, mallet, etc. The auxiliary hand can be positioned perpendicular to the shaft.

Auxiliary fins can be bolted, clamped or otherwise secured to the axial fins, transverse fins, and radial fins to increase the effective height of the fins. The aquatic exercise assembly can come in various sizes with larger sizes for men and more compact and smaller sizes for women and children.

It can, therefore, be seen that each of the embodiments has a generally impact-resistant water-engageable shaft 22 formed of a substantially water-impermeable material with a manually grippable handle portion 28 for being grasped under water and that each of the embodiments has an inner 64 and a pair of outer 34 and 36 hydrodynamic resistance assemblies that are operatively connected to the shaft 22 to deflect water and create a pressure head and fluid resistance to water flow as the shaft is moved in and through the water. Each hydrodynamic resistance assembly 34, 36 and 64 has a water-impingement surface with a cross-sectional area that is positioned radially or transversely to the axial length of the shaft 22. The cross-sectional area of the water-impingement surfaces of the hydrodynamic resistant assemblies 34, 36 and 64 span a distance (width), taken in a direction generally transverse to the shaft 22, is substantially greater than the maximum width of the shaft 22 to increase the water resistance of the water-impingement surfaces. Each hydrodynamic resistance assembly 34, 36 and 64 and its water-impingement surface is spaced an effective distance away from the manually grippable handle portion 28 of the shaft 22 to exert a hydrodynamic torque on the handle portion as the shaft 22 is being moved in or through the water.

The aquatic exercise assemblies provide a wider range of movement in the water with less stress on the joints of the user than is attainable with most types of conventional barbells and other exercise devices that are used on land and offers many advantages to physical therapists.

Among the many advantages of the novel aquatic dumbbell are:

1. Superior fluid resistance.
2. Outstanding hydrodynamics.
3. Improved aquatic exerciser.
4. Enhanced capability for physical therapy.
5. Greater ranges of aquatic exercises.
6. Quicker and more fuller strength development.
7. Better exercise workout in water.
8. Excellent structural strength and integrity.
9. Attractive.
10. Simple to use.
11. Safe.
12. Convenient.
13. Comfortable.
14. Portable.
15. Compact.
16. Economical.
17. Reliable.
18. Efficient.
19. Effective.

Although embodiments of the invention has been shown and described, it is to be understood that various modifications and substitutions, as well as rearrangements of parts, can be made by those skilled in the art without departing from the novel spirit and scope of this invention.

What is claimed is:

1. An aquatic exercise assembly for use in water to strengthen muscles, improve muscle tone and enhance muscular coordination, comprising:

a generally impact-resistant water-engageable shaft formed of substantially water-impermeable material having transverse fin-engaging end portions and a manually grippable portion for being grasped under water extending between said transverse fin-engaging end portions, said shaft being elongated and extending in an axial direction along an axis, said manually grippable portion of said shaft having a maximum width defining a thickness taken in a radial direction generally transverse to said axis and said shaft being movable in said water;

substantially symmetrical axially opposite transverse end fins secured to and extending transversely outwardly from said end portions of said shaft for creating an axial pressure head to water flow as said shaft is moved axially through the water to enhance hydrodynamic resistance to axial movement of said shaft through said water;

a plurality of elongated axial fins extending between and connecting said transverse fins for creating a transverse pressure head to water flow as said shaft is arcuately pivoted or moved transversely through the water to enhance hydrodynamic resistance to pivoting and transverse movements of said shaft in said water; and at least one lateral bridge fin providing a side barrier extending between and connecting said axial fins, said bridge fin positioned transverse to said shaft and creating a lateral pressure head when said shaft is moved laterally in the water.

2. An aquatic exercise assembly in accordance with claim 1 wherein said transverse fins diverge axially outwardly.

3. An aquatic exercise assembly in accordance with claim 1 including a plurality of outer fins extending outwardly from said transverse fins.

4. An aquatic exercise assembly for use in water to strengthen muscles, improve muscle tone and enhance muscular coordination, comprising:

a generally impact-resistant water-impermeable shaft formed of substantially water-impermeable material having axially opposite transverse fin-engageable end portions and an intermediate manually grippable portion positioned between said end portions for being grasped under water, said shaft being elongated and extending in an axial direction along an axis, said manually grippable portion of said shaft having a maximum width defining a thickness taken in a radial direction generally transverse to said axis and said shaft being moveable in said water;

substantially symmetrical, axially opposite outer transverse ends fins secured to end extending transversely outwardly from said end portions of said shaft, said transverse end fins spanning a transverse distance substantially greater than the maximum width of said shaft and providing outer hydrodynamic resistance assemblies, said transverse end fins being substantially frustoconical and diverging axially outwardly to provide outward concave frustoconical pockets for creating an axial pressure head to water flow as said shaft is moved axially through the water enhance hydrodynamic resistance to axial movement of said shaft through said water;

a plurality of water-engageable outer radial fins extending axially outwardly from said transverse end fins and in a direction generally radially outwardly from said fin-engaging end portions of said shaft, said outer fins being angularly disposed with respect to each other to define outer angular aquatic imperforate pockets for cuppingly engaging and deflecting water and creating a pressure head and fluid resistance to water flow as said shaft is moved in said water, each of said outer radial fins having a height extending adjacent one of said end of said shaft portions to an outer extremity of said outer radial fin substantially greater than the maximum thickness of said manually grippable portion of said shaft for enhanced hydrodynamic resistance, each of said outer radial fins having a substantially solid, water-impingement surface extending generally across said fin and having a substantially imperforate, water-impervious cross-sectional area to provide a substantially solid barrier extending generally radially to hydrodynamically engage said water;

a plurality of elongated axial fins extending between and connecting said outer transverse end fins for providing an inner hydrodynamic resistance assembly, said axial fins extending radially outwardly from said shaft, said axial fins having radial portions and elongated intermediate axial portions, said radial portions extending radially outwardly from said shaft and axially inwardly from said transverse end fins, said intermediates axial portions extending axially between and connecting said radial portions, said intermediate axial portions being positioned substantially parallel to and spaced radially outwardly of said shaft, said axial fins cooperating with said shaft to define at least one access opening therebetween to accommodate grasping f said shaft, said axial fins being positioned an effective distance from said manually grippable portion for exerting a hydrodynamic force on said manually grippable portion of said shaft as said shaft is being moved angularly and transversely in said water to strengthen the muscles of the user of the aquatic exercise assembly; and at least one lateral bridge fin providing a side barrier extending between and connecting said axial fins, said bridge fin positioned transverse to said shaft and creating a lateral pressure head when said shaft is moved laterally in the water.

5. An aquatic exercise assembly in accordance with claim 4 wherein said bridge fin comprises an axial bridge portion, transverse bridge portions extending laterally outwardly of said axial bridge portion, and radial bridge portions extending radially outwardly of said axial bridge portion.

6. An aquatic exercise assembly in accordance with claim 4 wherein:

said symmetrical frustooonical transverse end fins have a generally polygonal periphery with arcuate edges;

said outer radial fins have a subsantially triangular periphery;

said axial portions of said axial fins have a greater span in the radial direction than said radial fins and said transverse end fins, and said axial portion has substantially straight outer edges positioned substantially parallel to said shaft;

said radial portions of said axial fins are flared axially inwardly and radially outwardly from said transverse end fins at an angle of inclination ranging from about 15 degrees to about 75 degrees;

said radial bridge portions have a substantially triangular periphery;

said transverse bridge portions have a substantially trapezoidal periphery; and said axial bridge portion has substantially symmetrical, generally trapezoidal, transversely opposite ends attached to said axial portions of adjacent axial fins and an elongated, substantially rectangular, main body portion extending between and connecting said trapezoidal ends.

7. An aquatic exercise assembly in accordance with claim 4 wherein said bridge fins are spaced from said radial portions of said axial fins to define side openings and said aquatic exercise assembly includes water-engageable spokes extending through and substantially blocking said side openings.

8. An aquatic exercise assembly in accordance with claim 4 wherein said end potions of said shaft extend outwardly of said transverse fin.

9. An aquatic exercise assembly in accordance with claim 4 wherein said shaft is tubular and the aquatic exercise assembly has end caps for abuttingly engaging and covering said end portions of said shaft.

10. An aquatic exercise assembly in accordance with claim 4 wherein at least one of said fins has raised ribs and indented portions to provide hydrodynamic pockets to increase the hydrodynamic resistance of said aquatic exercise assembly as said aquatic exercise assembly is moved through said water.

* * * * *